United States Patent [19]

Collins et al.

[11] Patent Number: 4,846,443

[45] Date of Patent: Jul. 11, 1989

[54] FLOOR COVERING INSTALLATION TOOL

[75] Inventors: Harvey C. Collins, 7143 S. River Rd., Marine City, Mich. 48039; Larry Shovan, Goodells; David Collins, Armada, both of Mich.

[73] Assignee: Harvey C. Collins, Marine City, Mich.

[21] Appl. No.: 218,691

[22] Filed: Jul. 13, 1988

[51] Int. Cl.[4] ..... B66F 11/00

[52] U.S. Cl. ..... 254/8 B; 254/133 R

[58] Field of Search ..... 29/239; 254/133, 134, 254/100, 8 B, DIG. 4; 269/17

[56] References Cited

U.S. PATENT DOCUMENTS

| | | | |
|---|---|---|---|
| 66,170 | 6/1987 | Patterson . | |
| 829,344 | 8/1906 | Larsen | 254/100 |
| 2,469,670 | 5/1949 | Thompson | 254/134 |
| 2,536,550 | 1/1951 | Hughes | 254/133 R |
| 2,786,649 | 3/1957 | Bottorff . | |
| 2,786,650 | 3/1957 | Bottorff | 254/134 |
| 2,910,270 | 10/1959 | Schultz . | |
| 3,081,066 | 3/1963 | Murawski | 29/239 |
| 3,426,752 | 2/1969 | Luica | 29/239 |
| 3,662,994 | 5/1972 | Johns | 29/239 |
| 4,194,726 | 3/1980 | Hance . | |

*Primary Examiner*—Robert C. Watson

*Attorney, Agent, or Firm*—Harness, Dickey & Pierce

[57] ABSTRACT

A floor covering installation tool for lifting partitions, furniture or the like. The tool includes a mechanism for raising and lowering a bracket. The bracket includes a member for securing the bracket to the raising and lowering mechanism. One or more lifters adapted for raising and lowering furniture, partitions or the like are coupled with the bracket. One or more elongated elements are coupled with the raising and lowering mechanism. The elongated elements may include a wedging mechanism to enable the moving of the elongated elements underneath furniture, partitions or the like.

9 Claims, 3 Drawing Sheets

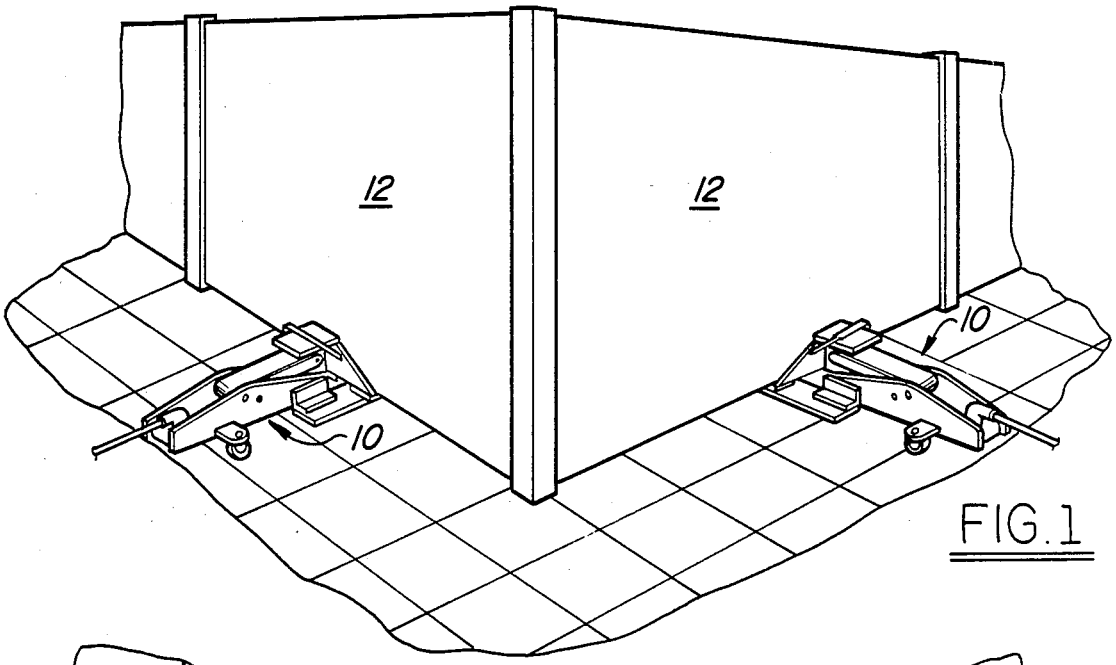
FIG. 1
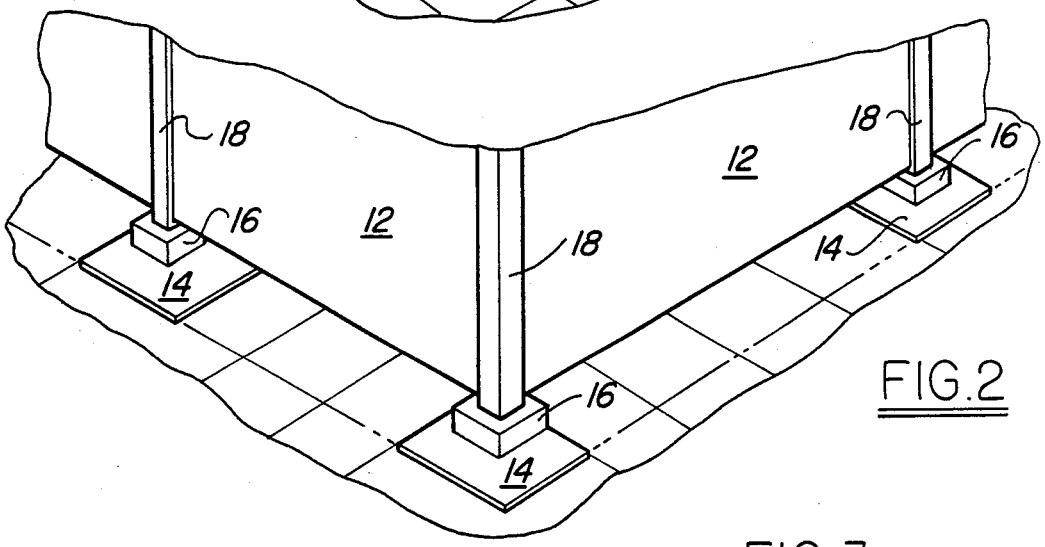
FIG. 2
FIG. 3
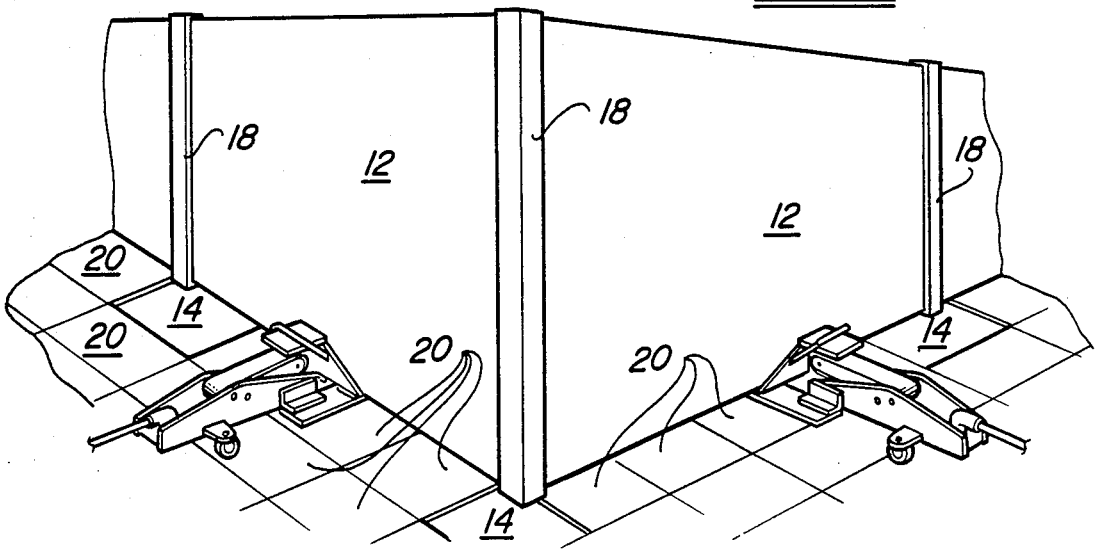

FLOOR COVERING INSTALLATION TOOL

BACKGROUND AND SUMMARY OF THE INVENTION

The present invention relates to floor covering installation and, more particularly, to a tool for raising and lowering furniture, partitions or the like during installation of flooring.

During the installation of carpet, ceramic tile or the like in existing buildings where furniture, especially modular partitions, need to be moved, the installer is faced with a reoccurring furniture moving dilemma. The installer may either move the furniture, partitions or the like by hand to one side of the room, install the carpet on that side of the room, move the furniture back onto the new floor covering, and install the remainder of the flooring and reposition the furniture. Another way is to raise the furniture, partitions or the like at its original position so that flooring may be positioned underneath the furniture partitions or the like.

A useful device for raising and lowering furniture, partitions or the like does not exist in the field. Thus, there is a need in the field to provide a device which raises and lowers furniture, partitions or the like so that flooring may be installed without the constant moving of furniture from one place to another.

Several types of devices exist for raising and lowering objects. The following U.S. patents illustrate such types of devices. The patents are: U.S. Pat. Nos. 66,170; 2,786,649; 2,910,270 and 4,194,726.

The present invention provides the art with a floor covering installation tool that lifts partitions, furniture or the like. The present invention enables installers to position flooring underneath of the furniture, partitions or the like without necessitating removal of the furniture from its original position within the room receiving the floor covering.

From the subsequent description and the appended claims taken in conjunction with the accompanying drawings, additional objects and advantages of the present invention will become apparent to those skilled in the art.

BRIEF DESCRIPTION OF THE DRAWINGS

FIG. 1 is a perspective view of the invention in accordance with the present invention in position to raise a partition.

FIG. 2 is a perspective view of a partition in a raised position.

FIG. 3 is a perspective view of the invention in accordance with the present invention with floor covering installed.

DETAILED DESCRIPTION OF THE PREFERRED EMBODIMENT

Figure 4:
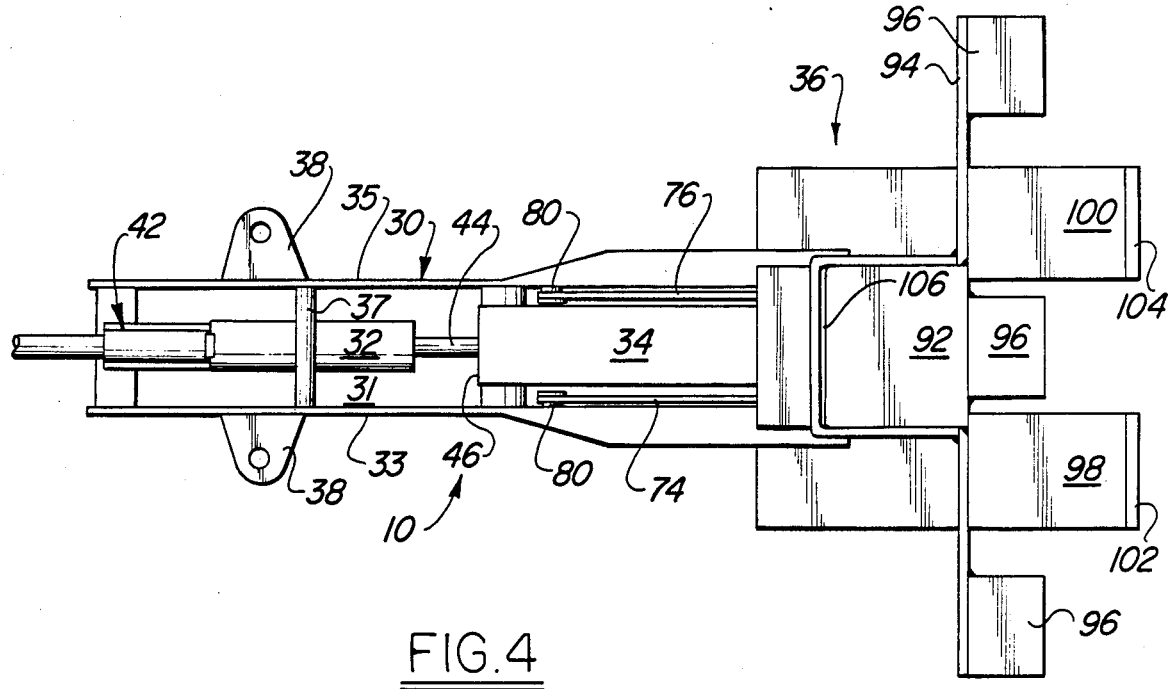
FIG. 4 is a top plan view of a floor covering tool in accordance with the present invention.

Referring to the figures, a flooring installation tool is illustrated and designated with the reference numeral

10. The installation tool 10 is utilized in the raising and lowering of partitions 12, furniture or the like to install flooring thereunder. Generally, the tool 10 is inserted underneath the partition 12, as shown in FIG. 1. The tool 10 is operated to raise the partition 12, as seen in FIG. 2. New flooring 14 and blocks 16 are positioned underneath the supports 18 of the partition, furniture or the like. The remainder of the new flooring 20 is positioned under the rest of the partition 12, furniture or the like. The tool 10 is then utilized to lower the partition 12 from its raised position to its position on top of the new flooring as illustrated in FIG. 3.

Moving to FIGS. 4–8, a better understanding of the floor covering installation tool 10 may be obtained. The floor covering installation tool generally includes a frame 30, piston cylinder 32, arm member 34 and a mechanism 36 for engaging partitions 12 to raise and lower the partitions 12.

Figure 5:
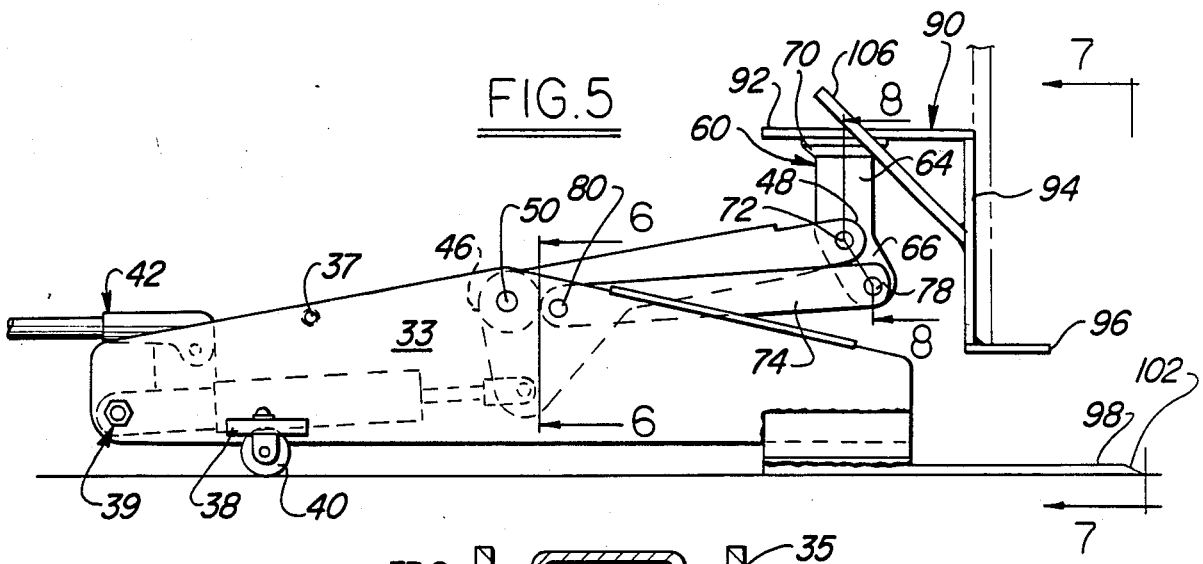
FIG. 5 is a side elevation view of a floor covering tool in accordance with the present invention.

The frame 30, piston cylinder 32 and arm member 34 are similar to those of conventional floor jacks. The frame 30 includes a base 31 and pair of side walls 33 and 35 extending therefrom. A pin 37 secures the side walls 33 and 35 together at their extending ends, as seen in FIGS. 4 and 5. Ears 38 extend from side walls 33 and 35. Rollers 40 to enable movement of the tool 10 are secured to the ears 38.

The piston cylinder 32 is generally of the hydraulic type. The piston cylinder 32 is secured to and between the side wall 33 and 35 by a nut and bolt fastener 39. A crank 42 is associated with the cylinder 32 to move a rod 44 in a horizontal reciprocating pattern.

Figure 6:
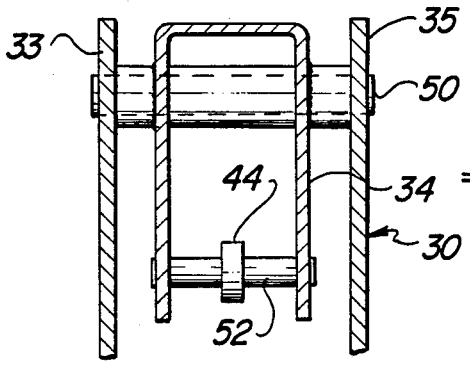
FIG. 6 is a vertical cross-section view of FIG. 5 through a plane defined by line 6—6 thereof.

The arm member 34 has two ends 46 and 48. End 46 is pivotally mounted between and to the frame side walls 33 and 35 by pin 50. Also, rod 44 is secured at end 46 of arm 34 by pin 52, as seen in FIG. 6. As the rod 44 moves in the piston cylinder 32, the arm 34 translates the rod's horizontal movement into vertical movement.

Figure 8:
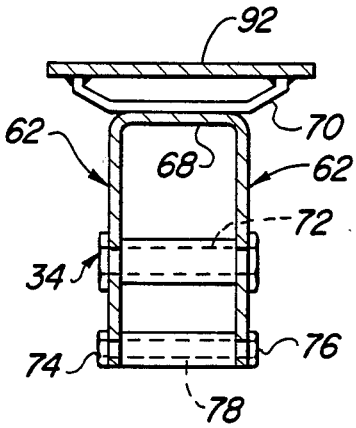
FIG. 8 is a vertical cross-section view of FIG. 5 along line 8—8 thereof.

The mechanism 36 for enabling lifting of partitions or the like includes a post member 60 and a bracket member 90. The post member 60 is generally comprised of a U-shaped plate having a pair of legs 62 with straight portions 64 and angular portions 66. A web portion 68 connects the two leg portions 62 together, as best seen in FIG. 8. The legs 62 are secured to the arm 34 by pin 72. A mounting member 70 is affixed, preferably by welding, to the web portion 68 to secure the bracket member 90 to the post member 60.

Figure 7:
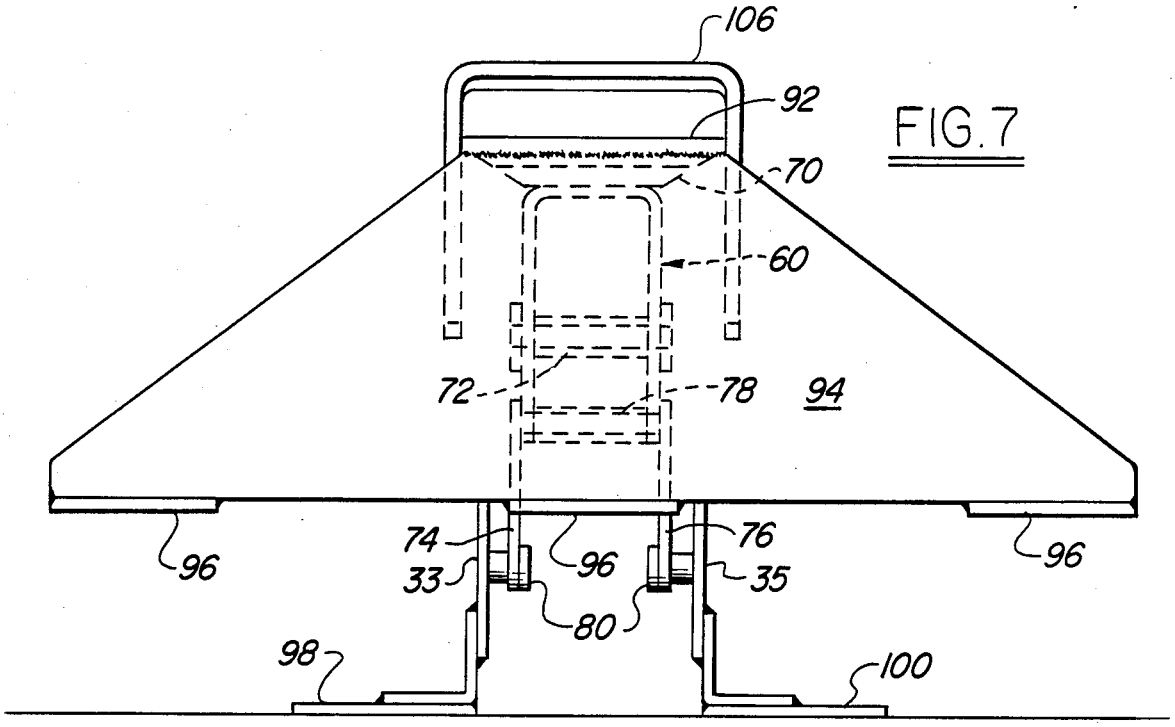
FIG. 7 is a front elevation view, viewed in direction of the plane defined by line 7—7 of FIG. 5.

A pair of rails 74 and 76 are secured to the angular portion 66 of the legs 62 by pin 78. The other ends of the rail 74 and 76 are pivotally secured to the side walls 33 and 35 by pins 80, as seen in FIG. 7. The two pin (72 and 78) setup of the U-shaped post member 60 prevents rotation of the post 60 while enabling up and down vertical movement.

The bracket member 90 includes a first plate portion 92 positioned substantially perpendicular in a horizontal plane to the straight portions 64 of the legs 62 of the post 60. The first portion 92 is welded to the mounting portion 70 of the post member 60. A backstop 94 is coupled with the plate portion 92 and extends substantially perpendicular thereto. A plurality of lifters 96, plate-like members, extend from the backstop 94 substantially perpendicular to the backstop 94. The backstop 94 has an overall triangular shape having three lifters 96, one at each end and one substantially in the middle to provide a wide span for lifting partitions 12, as seen in FIGS. 4 and 7.

The frame 30 includes a pair of elongated members 98 and 100 extending from side walls 33 and 35, respectively. The members 98 and 100 are L-shaped, having a portion welded to the sidewalls 33 and 35 and a portion which is substantially flat and parallel to the ground, as seen in FIGS. 5 and 7. The portion substantially parallel to the ground includes wedged ends 102 and 104 to enable the elongated elements to be inserted underneath the partitions 12 or the like to enable further sliding of the elongated members 98 and 100 under the partitions 12 until the backstop 94 abuts the partition or the like, as seen in FIGS. 1 and 3.

When the lifters 96 are on the ground, as seen in FIGS. 1 and 3, the lifters 96 are positioned adjacent to and in an alternating pattern with elongated members 98 and 100. As the partition 12 is lifted, the lifters 96 move to a position above the elongated members 98 and 100, as seen in FIG. 7.

A handle 106 is coupled with the first portion 92 and the backstop 94. The handle enables manual positioning of the tool 10 with respect to the partition. Also, the handle 106 enables the tool 10 to be carried from job to job.

While the above detailed description describes the preferred embodiment of the present invention, modifications, alterations and variations may be made to the present invention without deviating from the scope and fair meaning of the subjoined claims.

What is claimed is:

1. A floor covering installation tool for lifting furniture, partitions or the like comprising:

means for raising and lowering a bracket;

said bracket including means for securing said bracket to said raising and lowering means, a triangular shaped backstop for enabling abutment of furniture, partitions or the like, and one or more lifters extending from said back stop, and adapted for raising and lowering furniture, partitions or the like;

one or more elongated elements having two ends, one end coupled with and the other end freely extending from said raising and lowering means, said free extending end of said one or more elongated elements including means for wedging under furniture, partitions or the like for enabling said elongated elements to pass underneath the furniture, partitions or the like; and said one or more lifters adapted to move from a position wherein said one or more elongated elements and lifters being positioned substantially adjacent to the ground in an alternating pattern with said one or more elongated elements extending past said lifters to a position wherein said lifters move vertically.

2. The floor covering installation tool according to claim 1 further comprising two or more lifters positioned in substantially the same plane a desired distance apart such that said lifters provide a wide span to balance the furniture, partition or the like as it is lifted.

3. The floor covering installation tool according to claim 1 wherein said one or more elongated elements and lifters are substantially in the same plane when adjacent to the ground.

4. The floor covering installation tool according to claim 1 further comprising a pair of elongated elements both having a wedge on one of its ends.

5. A floor covering installation tool for lifting partitions or the like comprising:

a frame;

cylinder means for reciprocatingly driving a rod in a substantially horizontal direction, said cylinder means associated with said frame;

a movable arm member having two ends, one end pivotally secured to said frame member and coupled with said rod such that as said rod horizontally reciprocates said other free end of said arm member moves vertically;

a pair of elongated elements having two ends, one of said ends affixed to said frame and the other end freely extending from said frame; and means for raising and lowering furniture, partitions or the like, said raising and lowering means including a post member coupled with said arm free end and extending substantially vertically therefrom and a bracket including a first portion coupled with said post member and extending substantially horizontally therefrom, a second portion coupled with said first portion and extending substantially vertically therefrom, and one or more lifters coupled with said second portion extending substantially horizontally therefrom, said one or more lifters adapted to move from a position wherein said pair of elongated elements and one or more lifters being positioned substantially adjacent to the ground in an alternating pattern with said pair of elongated elements extending past said lifters to another position wherein said lifters move vertically.

6. The floor covering installation tool according to claim 5 further including a pair of elements both having two ends, one of said ends secured to said arm member and the other of said ends secured to said post member.

7. The floor covering installation tool according to claim 5 further comprising a pair of wheels coupled with said frame for enabling rolling movement of the floor covering tool.

8. The floor covering installation tool according to claim 5 further comprising a handle coupled with said first portion of said bracket.

9. A floor covering installation tool for lifting furniture, partitions or the like comprising:

means for raising and lowering a bracket;

said bracket including means for securing said bracket to said raising and lowering means, a back stop enabling abutment of furniture partitions or the like, said backstop having two or more lifters extending therefrom and adapted for raising and lowering furniture, partitions or the like;

one or more elongated elements having two ends, one end coupled with and the other end freely extending from said raising and lowering mean, said free extending end of said one or more elongated elements including means for wedging under furniture, partition or the like for enabling said elongated elements to pass underneath the furniture, partitions or the like; and said two or more lifters adapted to move from a position wherein said one or more elongated elements and lifters being positioned substantially adjacent to the ground in an alternating pattern with said one or more elongated elements extending past said lifters to a position wherein said lifters move vertically.

* * * * *